US007207570B1

(12) United States Patent
Forbes et al.

(10) Patent No.: US 7,207,570 B1
(45) Date of Patent: Apr. 24, 2007

(54) TRIVIA GAME

(76) Inventors: Edwena Forbes, 519 Parker St., Mc Rae, GA (US) 31055; Doyal Connell, 519 Parker St., Mc Rae, GA (US) 31055

( * ) Notice: Subject to any disclaimer, the term of this patent is extended or adjusted under 35 U.S.C. 154(b) by 0 days.

(21) Appl. No.: 11/371,501

(22) Filed: Mar. 10, 2006

(51) Int. Cl.
*A63F 9/00* (2006.01)
*A63F 9/18* (2006.01)

(52) U.S. Cl. ..... 273/458; 273/430

(58) Field of Classification Search ..... 273/440, 273/457–459, 429–431; 446/220
See application file for complete search history.

(56) References Cited

U.S. PATENT DOCUMENTS 3,623,728 A * 11/1971 Goldfarb ..... 273/109
4,232,477 A * 11/1980 Lin ..... 446/71
4,732,393 A 3/1988 Rita
D301,592 S 6/1989 Needler
4,837,955 A * 6/1989 Grabhorn ..... 40/214
4,848,773 A 7/1989 Lovik
D305,441 S 1/1990 Lovik
5,042,816 A 8/1991 Davis et al.
5,254,026 A * 10/1993 Kaiser ..... 446/220
5,454,569 A 10/1995 Walker
5,662,510 A * 9/1997 Wolens ..... 446/397
5,690,336 A 11/1997 Oliver
5,836,587 A 11/1998 Druce et al.
5,992,853 A * 11/1999 Rudell et al. ..... 273/287

* cited by examiner

*Primary Examiner*—Raleigh W. Chiu

(57) ABSTRACT

A trivia game includes providing a plurality of balloons. A plurality of trivia cards is also provided. Each of the trivia cards has a different trivia question positioned thereon with respect to remaining ones of the trivia cards. Each of the balloons has one of the trivia cards positioned therein. Music is also provided. Each of the balloons is inflated and the music is played while the inflated balloons are hit between a plurality of competitors. A competitor catches the balloon or balloons when the music stops and then popped to retrieve the trivia card p positioned in the caught one of the balloons. The competitor retrieving the trivia card then attempts to answer the question on the trivia card and will receive a quantity of points for correctly answering the question.

3 Claims, 2 Drawing Sheets

TRIVIA GAME

BACKGROUND OF THE INVENTION

1. Field of the Invention

The present invention relates to game devices and more particularly pertains to a new game device for asking trivia questions which includes the random selection of questions by hitting and catching balloons having game trivia cards positioned therein.

2. Description of the Prior Art

The use of game devices is known in the prior art. While these devices fulfill their respective, particular objectives and requirements, the need remains for a trivia game that includes more than the simple drawing of a card and answering a question on that card. The game should include the additional feature of having to hit and catch a balloon having a trivia question therein to allow random selection of the cards. This will also differ from a conventional game in that the players do not answer in a turn-based format but only those players that catch a balloon will answer the question. Further, such a game will add an aerobic element to the trivia game.

SUMMARY OF THE INVENTION

The present invention meets the needs presented above by generally providing a plurality of balloons. A plurality of trivia cards is also provided. Each of the trivia cards has a different trivia question positioned thereon with respect to remaining ones of the trivia cards. Each of the balloons has one of the trivia cards positioned therein. Music is also provided. Each of the balloons is inflated and the music is played while the inflated balloons are hit between a plurality of competitors. A competitor catches the balloon or balloons when the music stops and then popped to retrieve the trivia card p positioned in the caught one of the balloons. The competitor retrieving the trivia card then attempts to answer the question on the trivia card and will receive a quantity of points for correctly answering the question.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
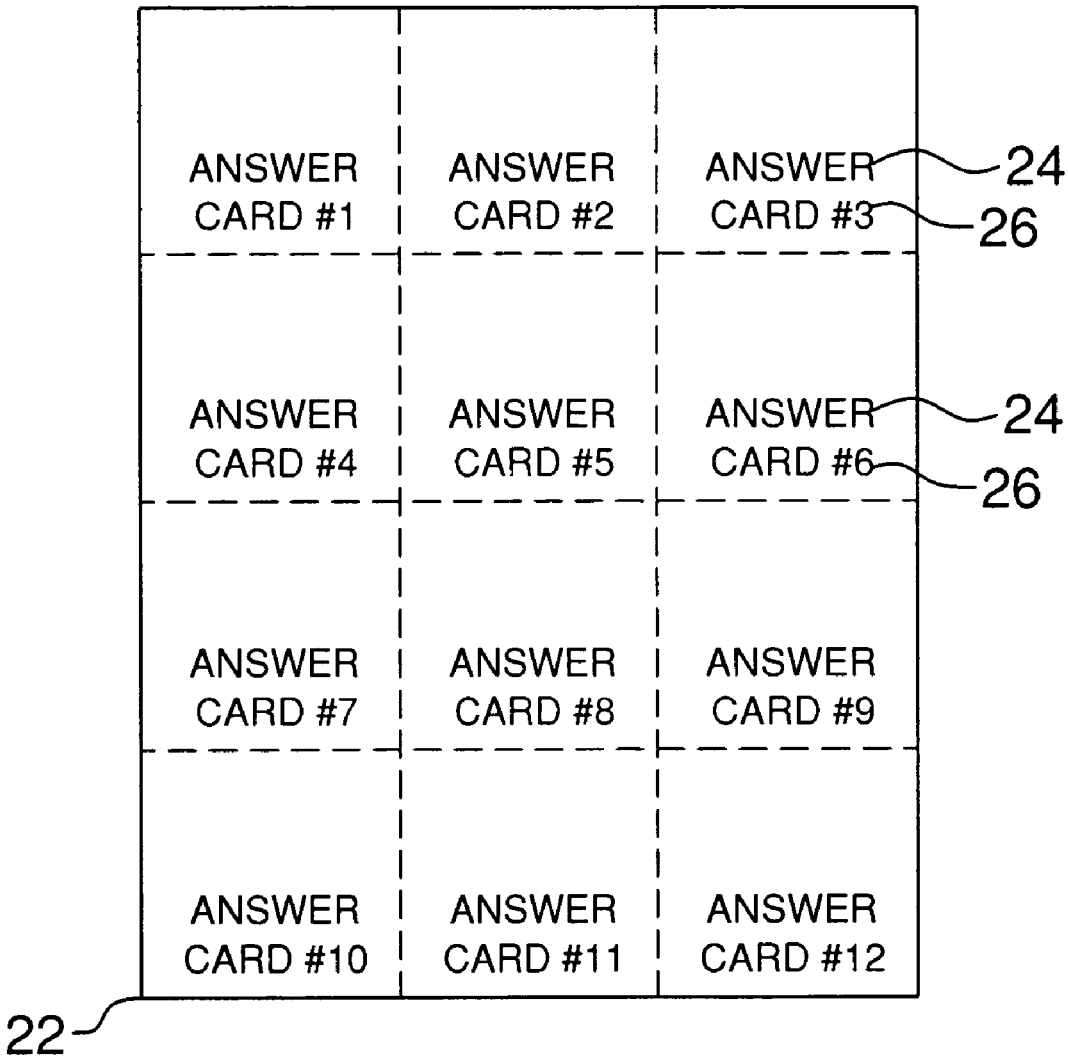
FIG. 1 is a front view of an answer card of a trivia game according to the present invention.
Figure 3:
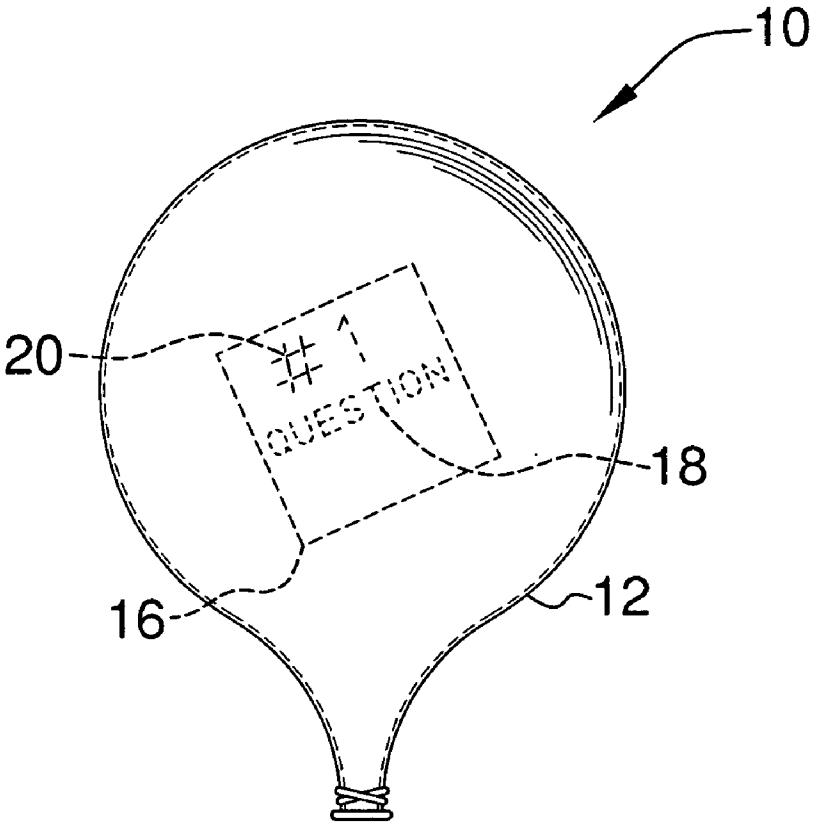
FIG. 3 is a side view of an inflated balloon of the present invention having a trivia card positioned therein.
Figure 2:
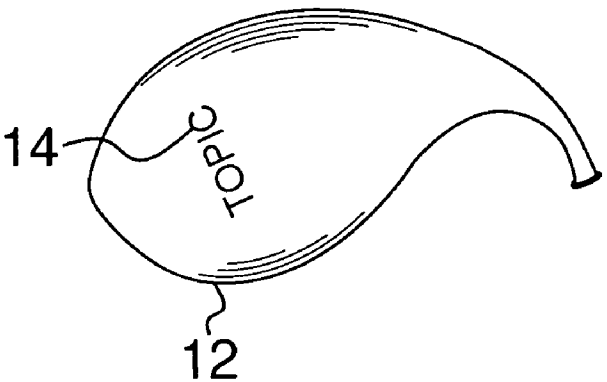
FIG. 2 is a side view of a deflated balloon of the present invention.

With reference now to the drawings, and in particular to FIGS. 1 through 3 thereof, a new game device embodying the principles and concepts of the present invention and generally designated by the reference numeral 10 will be described.

As best illustrated in FIGS. 1 through 3, the trivia game 10 generally comprises a plurality of balloons, which may be conventional balloons 12 of different sizes and colors. Word indicia 14 may be positioned on the balloons 12 to indicate topics of the game 10.

A plurality of trivia cards 16 is provided. Each of the trivia cards 16 has a different trivia question 18 positioned thereon with respect to remaining ones of the trivia cards 16. Each of the balloons 12 has one of the trivia cards 16 positioned therein. Number indicia 20 are positioned on each of the trivia cards 16 so that each of the trivia cards 16 has a different number indicia 20 thereon. The trivia questions 18 may be tailored to specific topics including, but not limited to, children's topics, religion, math, spelling, or any other topic, though topic specific questions may not be used and general trivia used instead.

An answer key 22 is provided that has answers 24 thereon for each the trivia question 18 positioned on each of the trivia cards 16. Each of the answers 24 is numbered a number 26 that corresponds to the number indicia 20. In this way, the trivia question 18 in each of the balloons 12 corresponds to one of the answers 24.

Music is provided which may be prerecorded on a player designed specifically for the game 10 or may be stored on conventional storage means such as a compact disc, digital video disc, or other similar storage means that may be played on a conventional music player. The balloons 12 are each inflated, and their ends tied so that they remain inflated.

Competing teams are chosen which may include multiple teams of one or more competitors. The music is played and at least one balloon 12, and up to at least one balloon 12 per competitor, is bounced and hit between the competitors. When the music stops, the competitors each try to catch one of the balloons 12 being hit. Those who have a caught balloon 12 then pop the caught balloon 12 to retrieve the trivia card 16 therein. The competing team that includes the person who caught the balloon attempts to answer the question 18 on the trivia cards 16 retrieved from the popped balloon 12.

When a competitor or team answers the trivia question 18 correctly, that competitor or team receives a quantity of points. The number of points may vary depending on topic and difficulty of question, or they may be a fixed number of points. For example, however, each question may be worth 10 points to the competitor correctly answering the question. The steps of playing the music, catching the balloons 12 when the music stops, popping the caught one of the balloons 12 and attempting to answer the questions 18 on the retrieved ones of the trivia cards 16 are repeated until all of the balloons 12 have been popped. The competitor or competing team having the greatest quantity of total points wins the game 10. The game 10 may include the further rule of providing an opportunity to answer a trivia question 18 by a different competitor if the competitor first attempting to answer the trivia question 18 fails to correctly do so.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A method of playing a trivia game comprising the steps of:

providing a plurality of balloons;

providing a plurality of trivia cards, each of said trivia cards having a different trivia question positioned thereon with respect to remaining ones of said trivia cards, each of said balloons having one of said trivia cards positioned therein;

providing music;

inflating each of said balloons;

playing said music;

hitting at least one of said balloons between a plurality of competitors;

catching one of said balloons when said music stops;

popping a caught one of said balloons and retrieving said trivia card positioned in said caught one of said balloons;

attempting to answer said trivia question on the retrieved one of said trivia cards; and receiving a quantity of points for correctly answering one of said trivia questions.

2. A method of playing a trivia game comprising the steps of:

providing a plurality of balloons;

providing a plurality of trivia cards, each of said trivia cards having a different trivia question positioned thereon with respect to remaining ones of said trivia cards, each of said balloons having one of said trivia cards positioned therein;

providing an answer key, said answer key having answers thereon for each said trivia question positioned on each of said trivia cards;

providing music;

inflating each of said balloons;

playing said music;

hitting at least one of said balloons between a plurality of competitors;

catching one of said balloons when said music stops;

popping a caught one of said balloons and retrieving said trivia card positioned in said caught one of said balloons;

attempting to answer said trivia question on the retrieved one of said trivia cards;

receiving a quantity of points for correctly answering one of said trivia questions;

repeating the steps of playing the music, catching said balloons when said music stops, popping the caught one of said balloons and attempting to answer said trivia questions on the retrieved ones of said trivia cards until all of said balloons have been popped; and winning the game by the competitor having the greatest quantity of total points.

3. A method of playing a trivia game comprising the steps of:

providing a plurality of balloons;

providing a plurality of trivia cards, each of said trivia cards having a different trivia question positioned thereon with respect to remaining ones of said trivia cards, each of said balloons having one of said trivia cards positioned therein, number indicia being positioned on each of said trivia cards, each of said trivia cards having a different number indicia thereon;

providing an answer key, said answer key having answers thereon for each said trivia question positioned on each of said trivia cards, each of said answers being numbered a number corresponding with one of said number indicia on said trivia cards such that each of said answers matches a corresponding one of said trivia questions; providing music;

inflating each of said balloons;

playing said music;

hitting at least one of said balloons between a plurality of competitors;

catching one of said balloons when said music stops;

popping a caught one of said balloons and retrieving said trivia card positioned in said caught one of said balloons;

attempting to answer said trivia question on the retrieved one of said trivia cards;

receiving a quantity of points for correctly answering one of said trivia questions;

repeating the steps of playing the music, catching said balloons when said music stops, popping the caught one of said balloons and attempting to answer said trivia questions on the retrieved ones of said trivia cards until all of said balloons have been popped; and winning the game by the competitor having the greatest quantity of total points.

* * * * *